US009315288B2

(12) United States Patent
Pinkstone et al.

(10) Patent No.: US 9,315,288 B2
(45) Date of Patent: Apr. 19, 2016

(54) CARTON HAVING A CONTAINER AND A CARRIER

(71) Applicant: Graphic Packaging International, Inc., Atlanta, GA (US)

(72) Inventors: Felicia A. Pinkstone, Aston, PA (US); Michael Keith Hockin, Traverse City, MI (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/325,617

(22) Filed: Jul. 8, 2014

(65) Prior Publication Data

US 2015/0014403 A1 Jan. 15, 2015

Related U.S. Application Data

(60) Provisional application No. 61/957,649, filed on Jul. 9, 2013.

(51) Int. Cl.

| | |
|---|---|
| ***B65D 5/42*** | (2006.01) |
| ***B65D 5/02*** | (2006.01) |
| ***B65B 5/06*** | (2006.01) |
| ***B65D 5/48*** | (2006.01) |
| ***B65D 5/52*** | (2006.01) |

(52) U.S. Cl.

CPC ..... *B65D 5/4204* (2013.01); *B65D 5/528* (2013.01); *B65D 5/5273* (2013.01)

(58) Field of Classification Search

USPC ..... 229/120.06, 120.26, 904, 120.13, 405, 229/120.02, 120.03, 162.7; 206/193; 220/738

See application file for complete search history.

(56) References Cited

U.S. PATENT DOCUMENTS

| | | | |
|---|---|---|---|
| D115,651 | S | 7/1939 | Ford et al. |
| D120,673 | S | 5/1940 | Jung |
| 2,348,378 | A | 5/1944 | Goodyear |
| 2,586,301 | A | 2/1952 | Castle |
| 2,794,585 | A | 6/1957 | Wagner |
| 3,013,710 | A | 12/1961 | Kronson et al. |
| 3,257,027 | A | 6/1966 | Weiss |
| 3,640,380 | A | 2/1972 | Huffman |
| D242,901 | S | 1/1977 | Lohrbach |
| 4,007,869 | A | 2/1977 | Stolkin et al. |
| 4,238,069 | A | 12/1980 | Morris, Jr. |
| 4,397,393 | A | 8/1983 | Pergande et al. |

(Continued)

FOREIGN PATENT DOCUMENTS

| | | |
|---|---|---|
| EP | 0 639 504 | 2/1995 |
| GB | 889 718 | 2/1962 |
| SE | 140 388 | 5/1953 |

*Primary Examiner* — Christopher Demeree

(74) *Attorney, Agent, or Firm* — Womble Carlyle Sandridge & Rice, LLP

(57) ABSTRACT

A carton for holding a first product and a second product. The carton comprises a container comprising a plurality of panels that extend at least partially around an interior of the container. The plurality of panels comprises a front panel, a first side panel, a second side panel, and at least one back panel. The interior is for holding the first product. The plurality of panels are foldably connected at a bottom edge of the container. A carrier is attached to at least one of the plurality of panels for holding the second product. An attachment flap is foldably connected at the bottom edge of the container. The attachment flap is foldably connected to at least one of the plurality of panels and attaches the carrier to the container.

45 Claims, 11 Drawing Sheets

(56) References Cited

U.S. PATENT DOCUMENTS

| | | | | |
|---|---|---|---|---|
| 4,530,459 | A | 7/1985 | Maroszek | |
| 4,601,390 | A | 7/1986 | Rosenthal et al. | |
| D319,388 | S | 8/1991 | McIntosh, Jr. et al. | |
| 5,299,734 | A | 4/1994 | Lane | |
| 5,400,901 | A | 3/1995 | Harrelson | |
| 5,501,335 | A | 3/1996 | Harris | |
| 5,524,814 | A | 6/1996 | Davis | |
| 5,540,333 | A * | 7/1996 | Gonzalez et al. | 206/541 |
| D373,079 | S | 8/1996 | Fahlen | |
| 5,551,556 | A | 9/1996 | Sutherland | |
| 5,595,291 | A | 1/1997 | Negelen | |
| D386,680 | S | 11/1997 | Johnson | |
| 5,950,912 | A | 9/1999 | Economopoulos | |
| 6,439,452 | B1 | 8/2002 | Tsao | |
| 6,530,516 | B1 | 3/2003 | Ritter | |
| 7,476,830 | B2 | 1/2009 | Middleton et al. | |
| 7,617,969 | B2 | 11/2009 | Oliveira | |
| 8,365,980 | B2 | 2/2013 | Wettlaufer et al. | |
| 8,534,538 | B2 | 9/2013 | Fitzwater | |
| 8,584,884 | B2 * | 11/2013 | Learn et al. | 220/23.8 |
| 2003/0213705 | A1 | 11/2003 | Woog | |
| 2006/0016863 | A1 * | 1/2006 | Holt et al. | 229/120.13 |
| 2006/0091190 | A1 | 5/2006 | Nikolai | |
| 2007/0051784 | A1 * | 3/2007 | Money et al. | 229/115 |
| 2011/0180593 | A1 | 7/2011 | Wettlaufer et al. | |

* cited by examiner

CARTON HAVING A CONTAINER AND A CARRIER

CROSS-REFERENCE TO RELATED APPLICATIONS

This application claims the benefit of U.S. Provisional Application No. 61/957,649, which was filed on Jul. 9, 2013.

INCORPORATION BY REFERENCE

U.S. Provisional Application No. 61/957,649, which was filed on Jul. 9, 2013, is hereby incorporated by reference for all purposes as if presented herein in its entirety.

BACKGROUND OF THE DISCLOSURE

The present disclosure generally relates to packages or cartons for carrying, holding, and dispensing products, such as food products. More specifically, the present disclosure relates to carriers for food and beverages.

SUMMARY OF THE DISCLOSURE

In general, one aspect of the disclosure is generally directed to a carton for holding a food product. The carton can comprise a plurality of panels at least partially enclosing an interior of the carton, and features for forming a carrier sleeve. The carrier sleeve may be at least partially attached to the carton and allow for carrying of a beverage container and the contents of the carton simultaneously.

In another aspect, the disclosure is generally directed to a carton for holding a first product and a second product. The carton comprises a container comprising a plurality of panels that extend at least partially around an interior of the container. The plurality of panels comprises a front panel, a first side panel, a second side panel, and at least one back panel. The interior is for holding the first product. The plurality of panels are foldably connected at a bottom edge of the container. A carrier is attached to at least one of the plurality of panels for holding the second product. An attachment flap is foldably connected at the bottom edge of the container. The attachment flap is foldably connected to at least one of the plurality of panels and attaches the carrier to the container.

In another aspect, the disclosure is generally directed to a blank for forming a carton for holding a first product and a second product. The blank comprises a container portion for forming a container for holding the first product. The container portion comprises a plurality of panels for forming an interior of the container. The plurality of panels comprises a front panel, a first side panel, a second side panel, and at least one back panel. The blank comprises a carrier portion for forming a carrier for holding the second product, and an attachment flap foldably connected to at least one of the plurality of panels at a lateral fold line for forming a bottom edge of the container. The attachment flap is for attaching the carrier to the container in the carton formed from the blank.

In another aspect, the disclosure is generally directed to a method of forming a carton for holding a first product and a second product. The method comprises obtaining a blank comprising a container portion a carrier portion, and an attachment flap. The container portion comprises a plurality of panels comprising a front panel, a first side panel, a second side panel, and at least one back panel. The attachment flap is foldably connected to at least one of the plurality of panels at a lateral fold line. The method comprises forming a container from the container portion by positioning the plurality of panels to extend at least partially around an interior of the container. The interior is for holding the first product. The plurality of panels are foldably connected at a bottom edge of the container. The method comprises positioning the attachment flap to attach the carrier portion to at least one of the plurality of panels, the positioning the attachment flap comprises folding the attachment flap at the lateral fold line to form the bottom edge of the container.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Cartons or packages according to the present disclosure can accommodate articles of numerous different shapes. For the purpose of illustration and not for the purpose of limiting the scope of the disclosure, the following detailed description describes articles at least partially disposed within the carton embodiments. In one embodiment, the articles held in the carton can be food and/or beverage products, but the articles could be other nonfood products without departing from the disclosure. In this specification, the terms "lower," "bottom," "upper", "top", "front", and "back" indicate orientations determined in relation to fully erected cartons.

Figure 1:
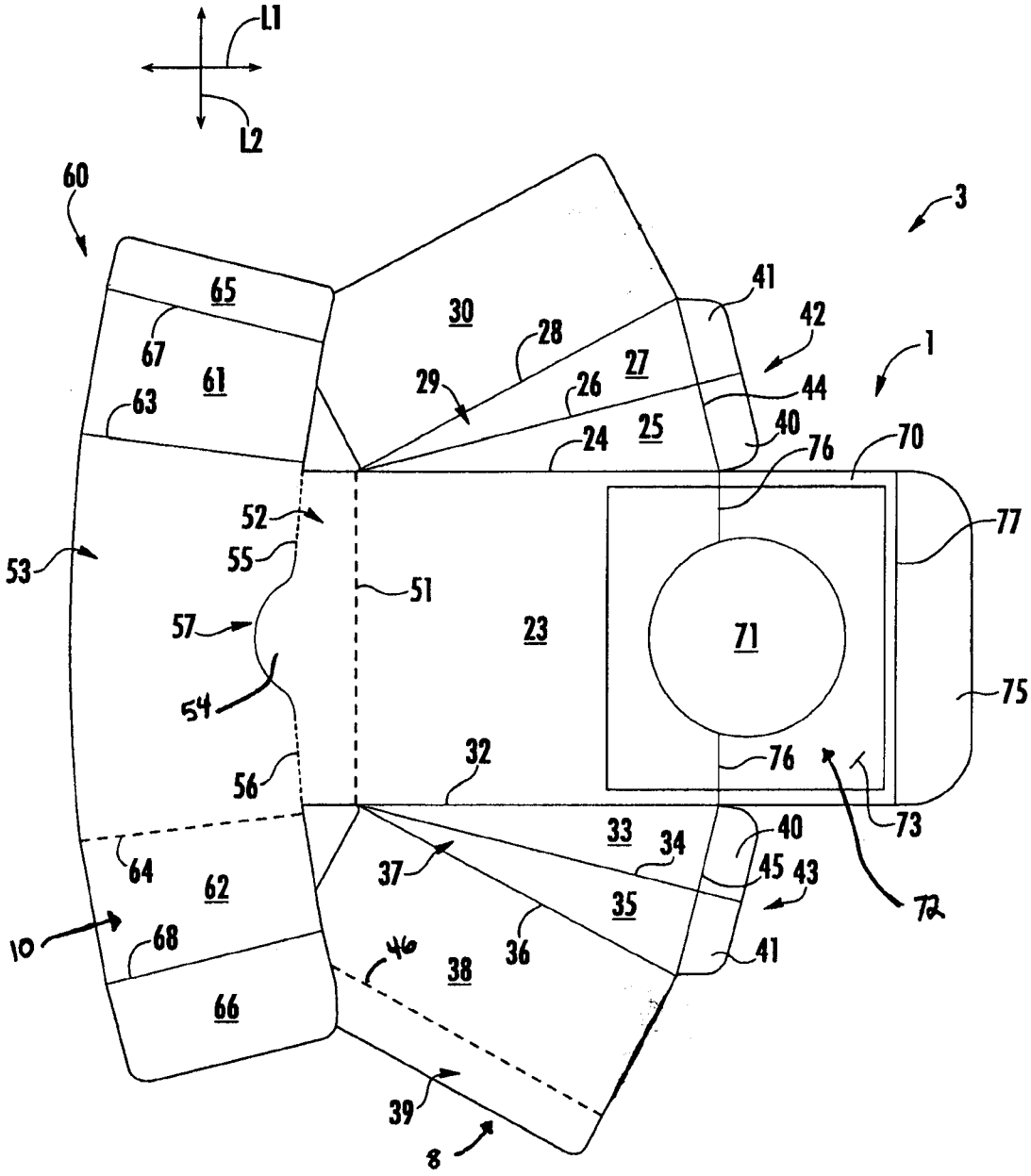
FIG. 1 is an exterior plan view of a blank used to form a carton in accordance with a first embodiment of the disclosure.
Figure 2:
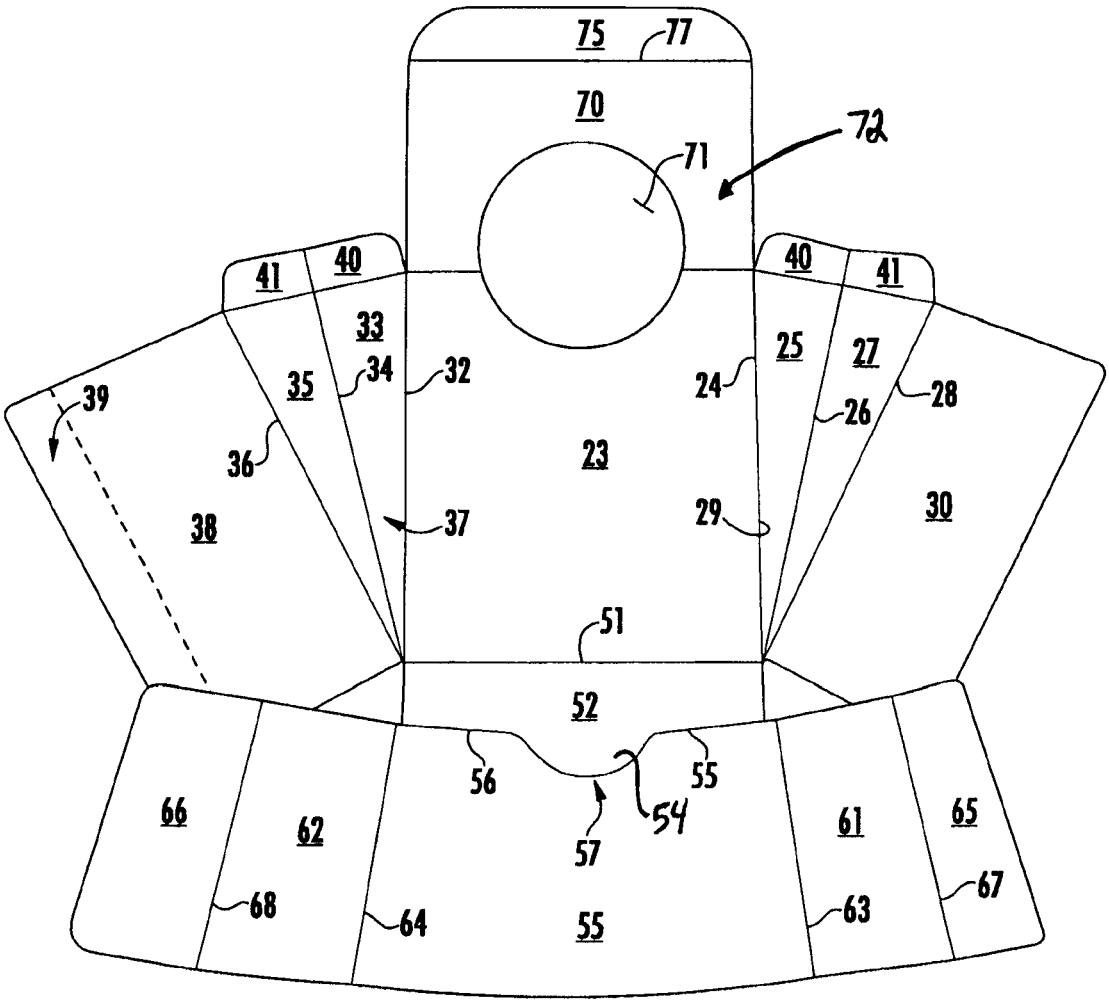
FIG. 2 is an interior plan view of the blank shown in FIG. 1.

FIG. 1 is a plan view of an exterior surface 1 of a blank 3 used to form a carton 5 (FIG. 9) of a first embodiment of the disclosure. The carton 5 has a container 6 that is configured to hold a first product such as a plurality of or a single serving of a food product (e.g., sandwiches, donuts, or any other food product), or any other suitable article or product within an interior 11 (FIG. 8) of the container 6. The carton 5 has a carrier 14 attached to the container 6 that can receive and carry a second product such as a beverage container 13. In one embodiment, the carrier 14 is a substantially sleeve-like holding formation (FIG. 9). The carton 5 can include various opening/closing features without departing from the disclosure.

As shown in FIG. 1, the blank 3 includes a container portion 8 for forming the container 6 and a carrier portion 10 for forming the carrier 14. An attachment flap 52 foldably connects the container portion 8 and the carrier portion 10. The blank 3 has a longitudinal axis L1 extending generally in the direction of the length of the blank and a lateral axis L2 extending generally in the direction of the width of the blank. The container portion 8 of the blank 3 includes a front panel 23 foldably connected to a first side panel 29 at a longitudinal fold line 24. The first side panel 29 may be a gusseted side panel with a first gusset panel 25 foldably connected to a second gusset panel 27 at oblique fold line 26. A second side panel 37 is foldably connected to the front panel 23 at a longitudinal fold line 32. The second side panel 37 may be a gusseted side panel with a third gusset panel 33 foldably connected to a fourth gusset panel 35 at oblique fold line 34. A first back panel 30 is foldably connected to the first side panel 29 at oblique fold line 28. A second back panel 38 is foldably connected to the second side panel 37 at oblique fold line 36. A top panel 70 is foldably connected to the front panel 23 at lateral fold line 76. An attachment flap 39 is foldably connected to the back panel 38 at fold line 46 for attaching to the first back panel 30. Alternatively, the attachment flap 39 could be foldably connected to the first back panel 30 without departing from the scope of the disclosure.

Figure 7:
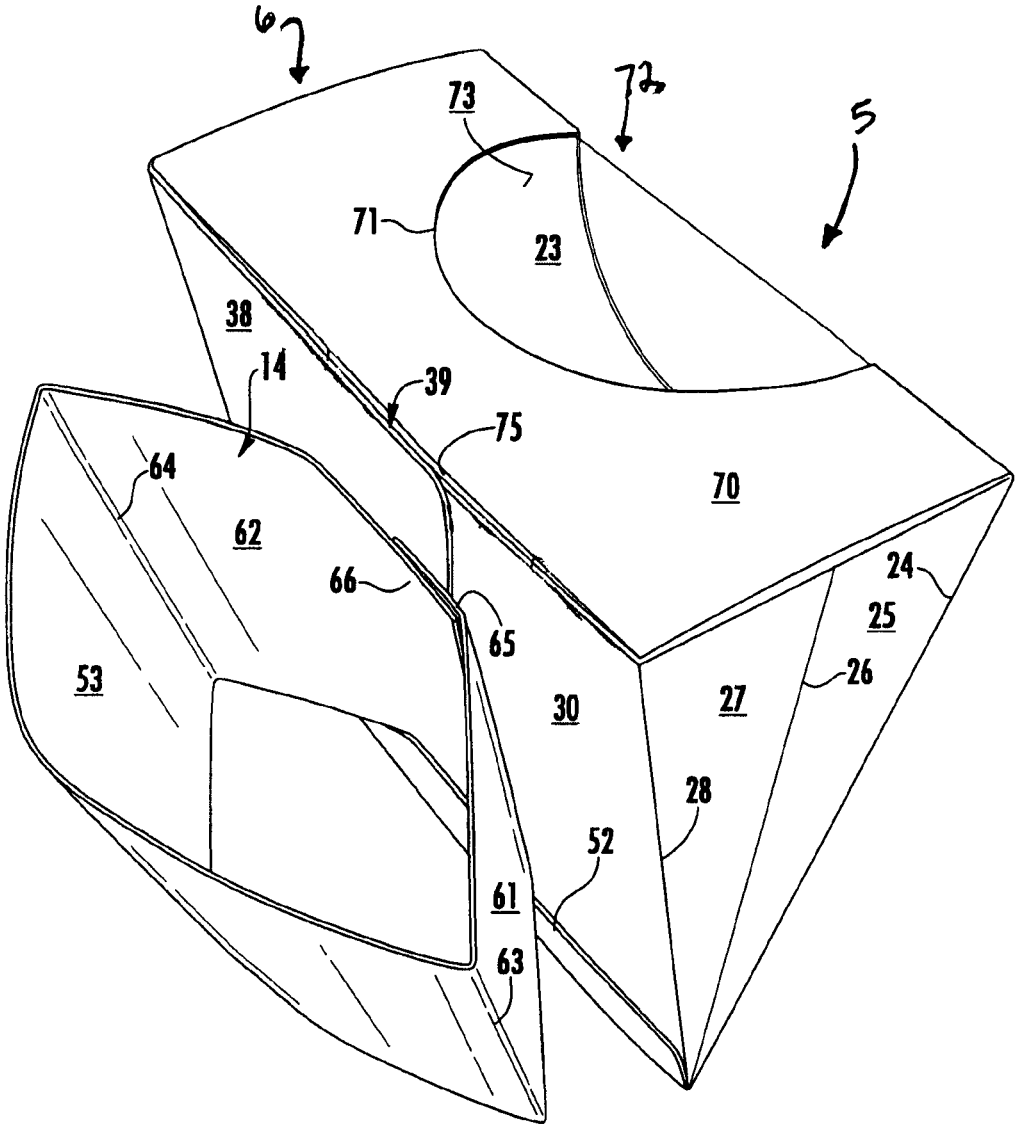
FIG. 7 is a back perspective view of the carton fully assembled.

In the illustrated embodiment, a top end flap 75 is foldably connected to the top panel 70 at lateral fold line 77. A side end flap 42 is foldably connected to the first side panel 29. A side end flap 43 is foldably connected to the second side panel 37. End flaps 42, 43 may each include a first flap portion 40 and a second flap portion 41 foldably connected to each other at respective oblique fold lines 26, 34. When the carton 5 is erected, the top panel 70 and end flaps 42, 43, 75 close a first (e.g., top) end of the container 6 (FIG. 7). In accordance with an alternative embodiment of the present disclosure, different panel and flap arrangements can be used for closing the container 6.

The end flaps 42, 43, 75 extend along a first marginal area of the blank 3, and are foldably connected at respective fold lines 44, 45, 77. The fold lines 44, 45, 77 may be, for example, substantially straight, or offset at one or more locations to account for blank thickness or for other factors. The end flaps 42, 43, 75 can be alternatively shaped, arranged, positioned, and/or omitted without departing from the disclosure.

As shown in FIG. 1, a window 72 is defined in the front panel 23 and the top panel 70. The opening 72 may be circular in some embodiments, and may include a transparent film cover 73 that covers an opening 71 in a portion of the front panel 23 and the top panel 70. The cover 73 is in face-to-face contact with a portion of the front panel 23 and the top panel 70 that is adjacent the opening 71. The cover is disposed thereon to protect contents of the container 6 while allowing viewing of the contents. The transparent film cover 73 can be any suitable transparent material and can be adhesively attached to the front panel 23 and the top panel 70. The window 72 may be otherwise shaped, arranged, and/or configured without departing from the scope of this disclosure.

As further shown in FIG. 1, the attachment flap 52 is foldably connected to the front panel 23 at lateral fold line 51. The attachment flap 52 has a base portion 52*a* and a protruding portion 54. The attachment flap is further defined by tear lines 55, 56 that extend from respective ends of a perforated cut line 57. In one embodiment, the perforated cut 57 at least partially defines the protruding portion 54 of the attachment flap 52. The attachment flap 52 could be otherwise shaped, arranged, and/or configured without departing from the disclosure.

Figure 6:
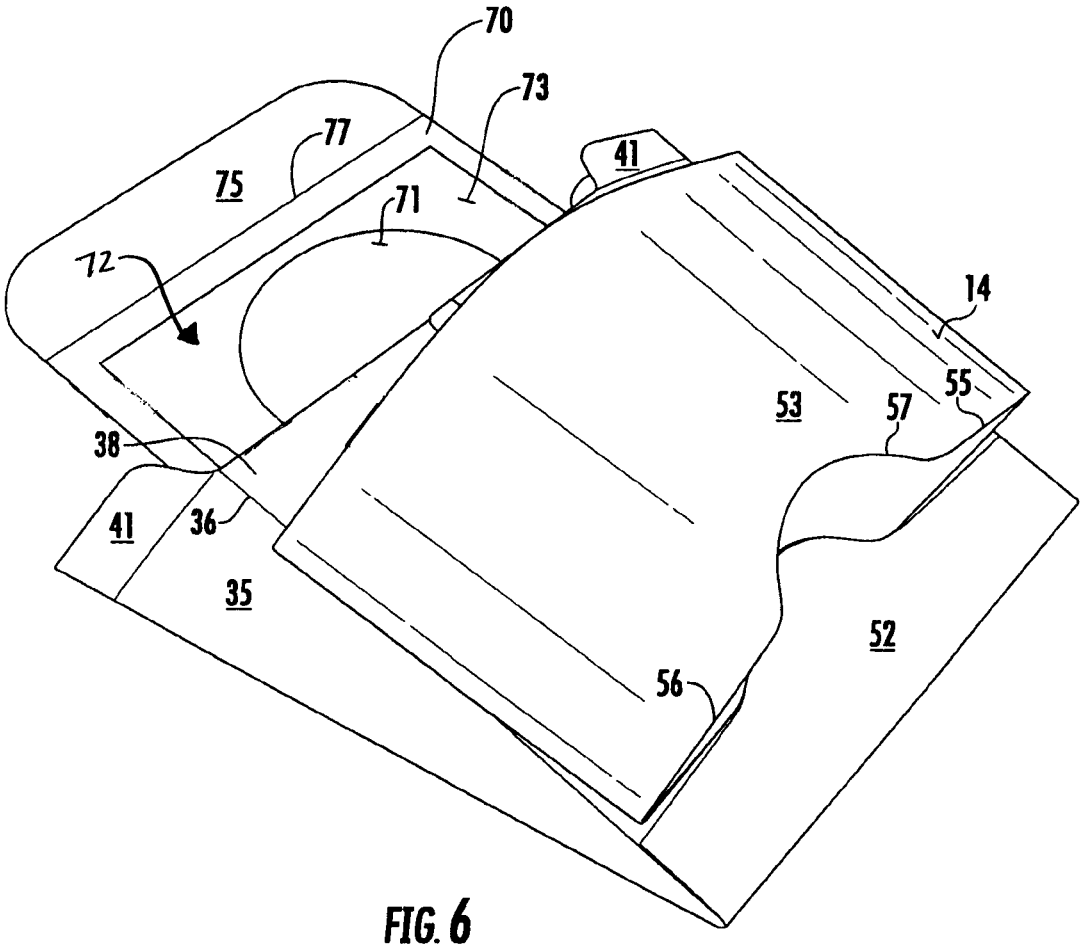
FIG. 6 is a front perspective view of the carton of FIG. 5.

In one embodiment, the carrier portion 10 of the blank 3 includes carrier features 60 for forming the carrier 14. The carrier features 60 include a first carrier panel 53 removably connected to the attachment flap 52 at tear lines 55, 56 and perforated cut line 57. Second and third carrier panels 61, 62 are foldably connected to the first carrier panel 53 at oblique fold lines 63, 64. A first attachment flap 65 is foldably connected to the second carrier panel 61 at oblique fold line 67, and a second attachment flap 66 is foldably connected to the third carrier panel 62 at oblique fold line 68. Generally, attachment flaps 65, 66 may be adhered to one another as well as to the first and second back panels 30, 38. Thereafter, tear lines 55, 56 and perforated cut line 57 may be torn such that carrier 14 is formed (FIG. 6). The carrier features 60 may be otherwise shaped, arranged, and/or configured without departing from the scope of this disclosure.

Figure 3:
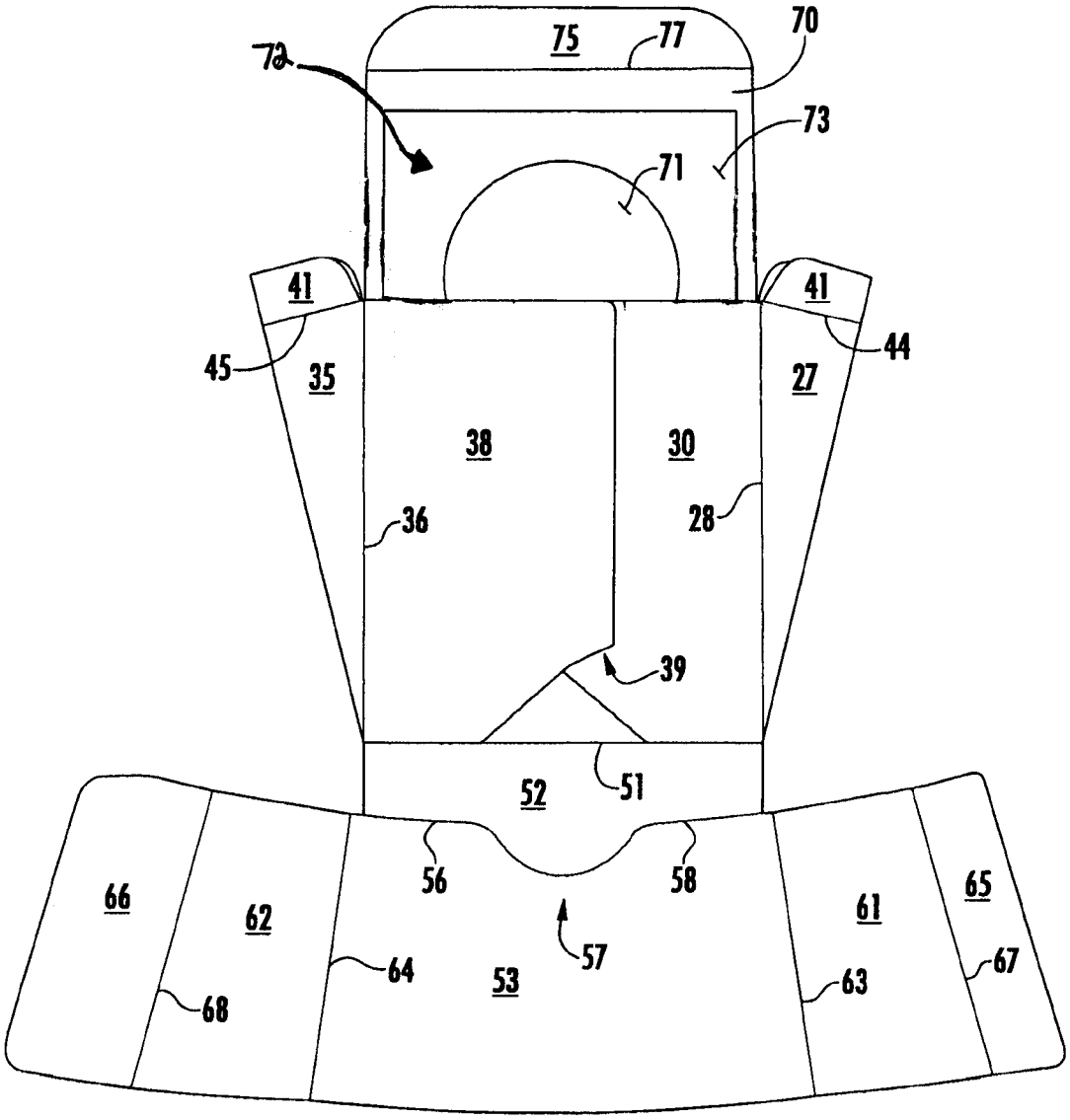
FIGS. 3-4 are front views of the blank shown in FIG. 1.
Figure 4:
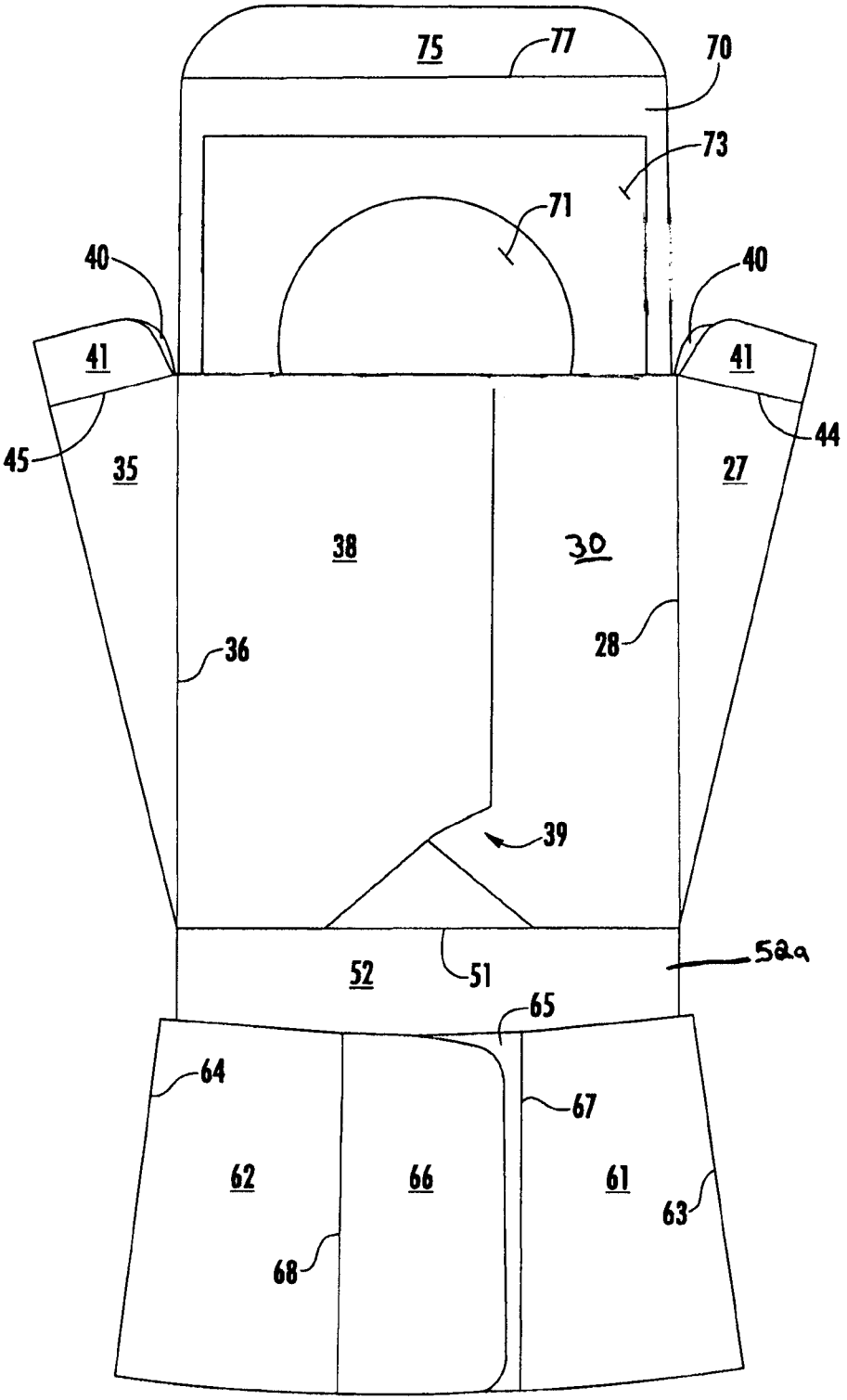
Figure 5:
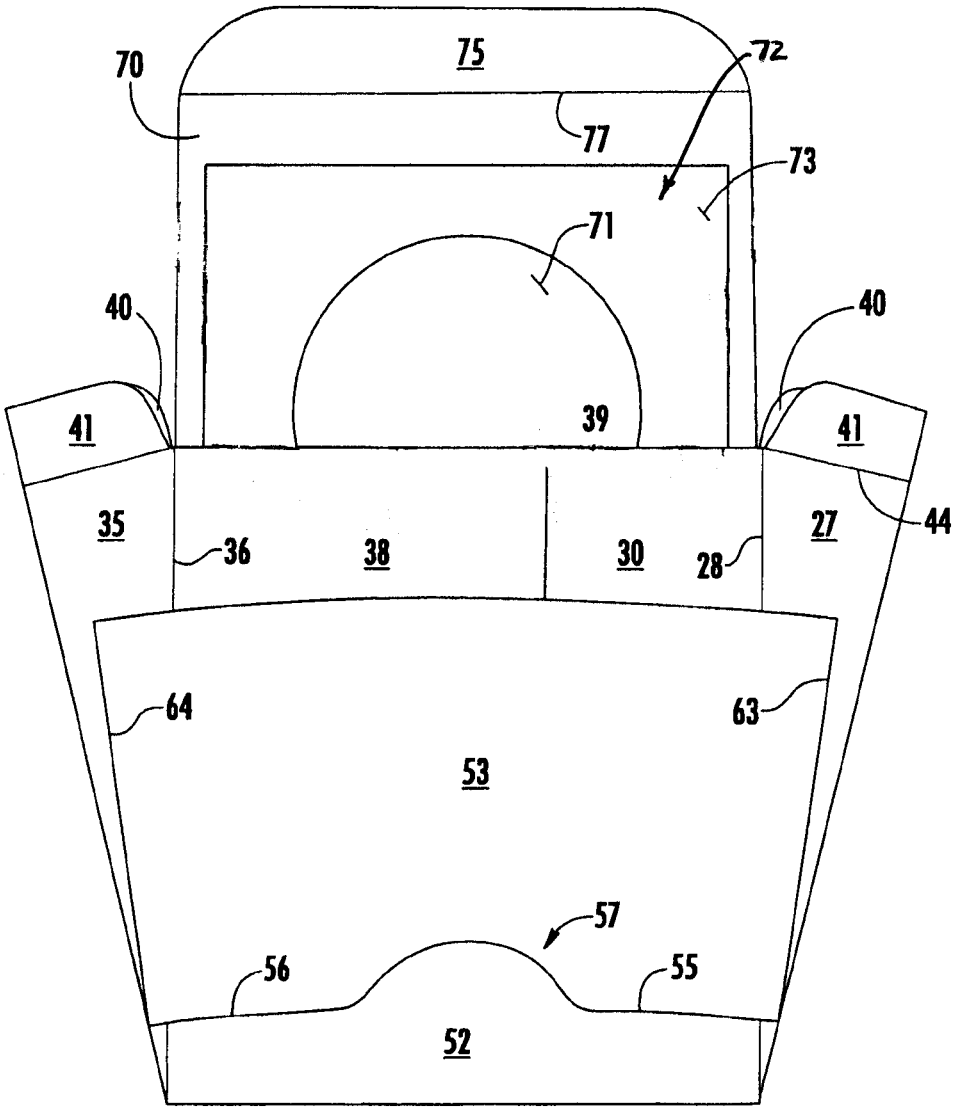
FIG. 5 is a front view of a carton in the flat configuration formed from the blank of FIG. 1.
Figure 8:
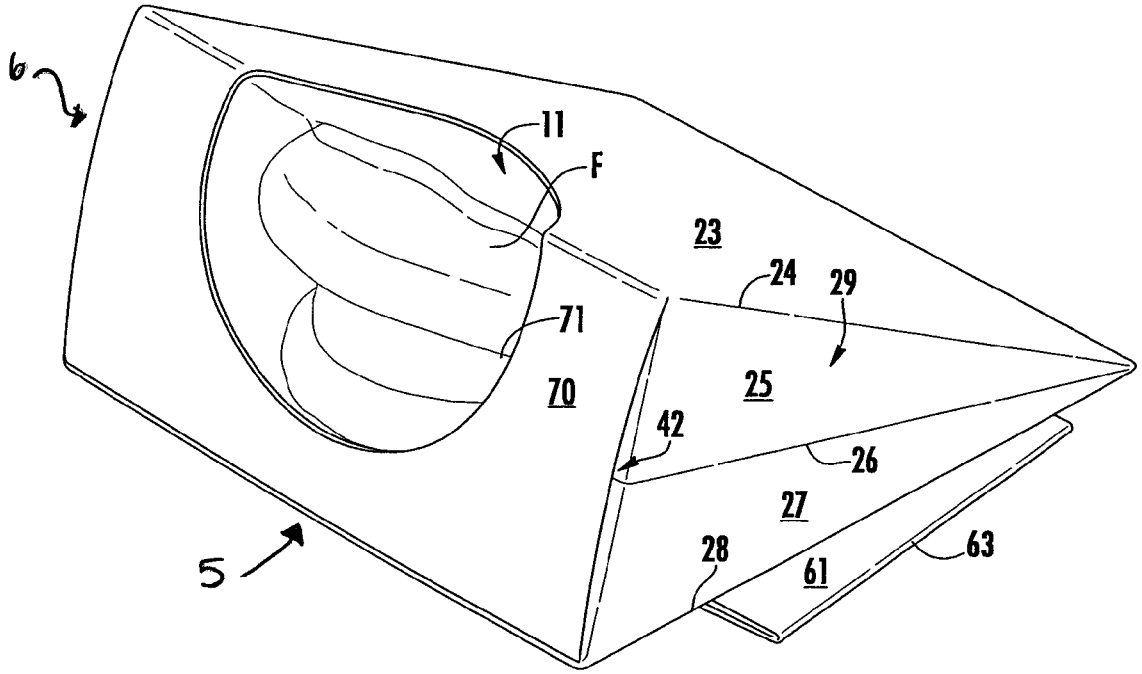
FIG. 8 is a top perspective view of the carton containing a food product
Figure 9:
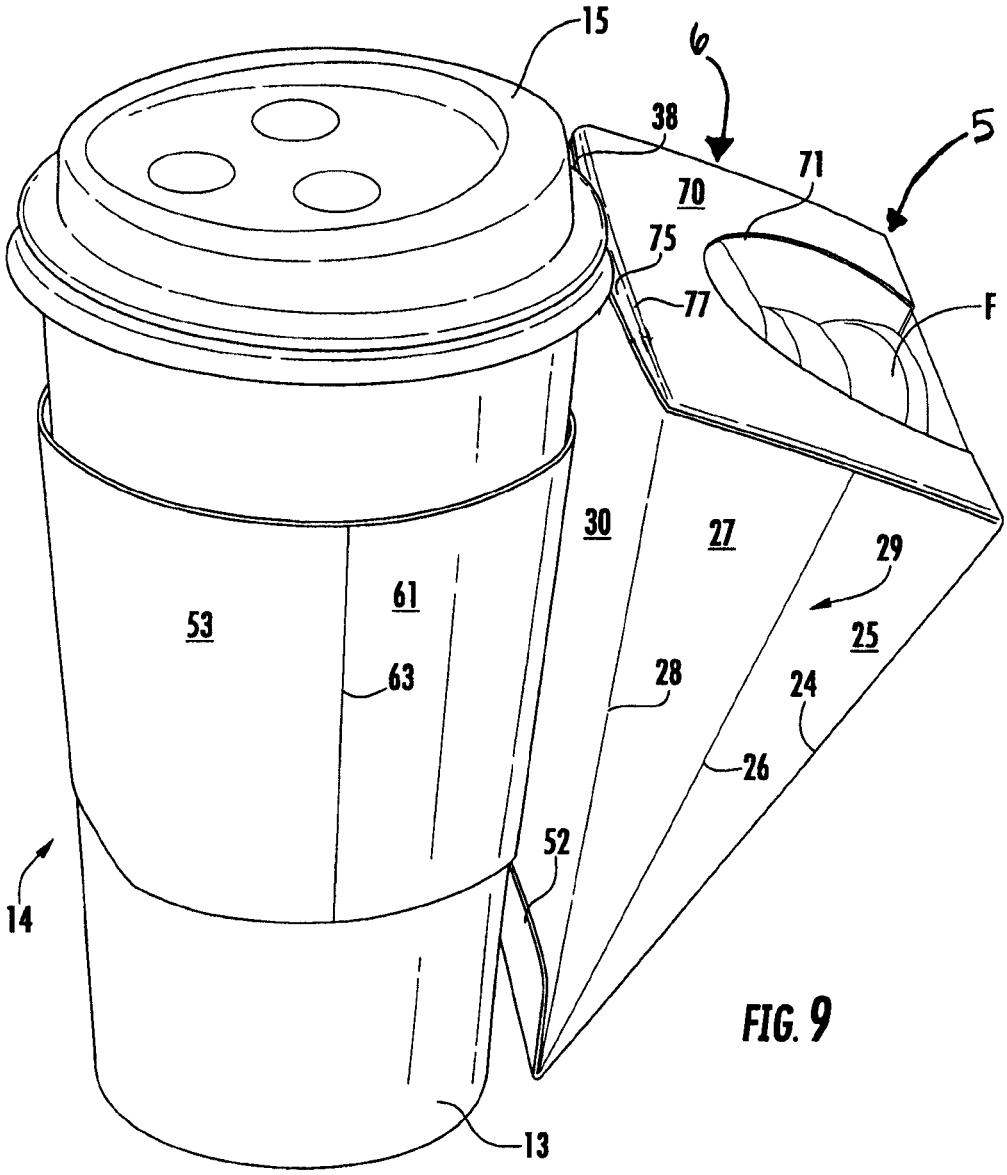
FIG. 9 is a side perspective view of the carton with a container and food product.
Figure 10:
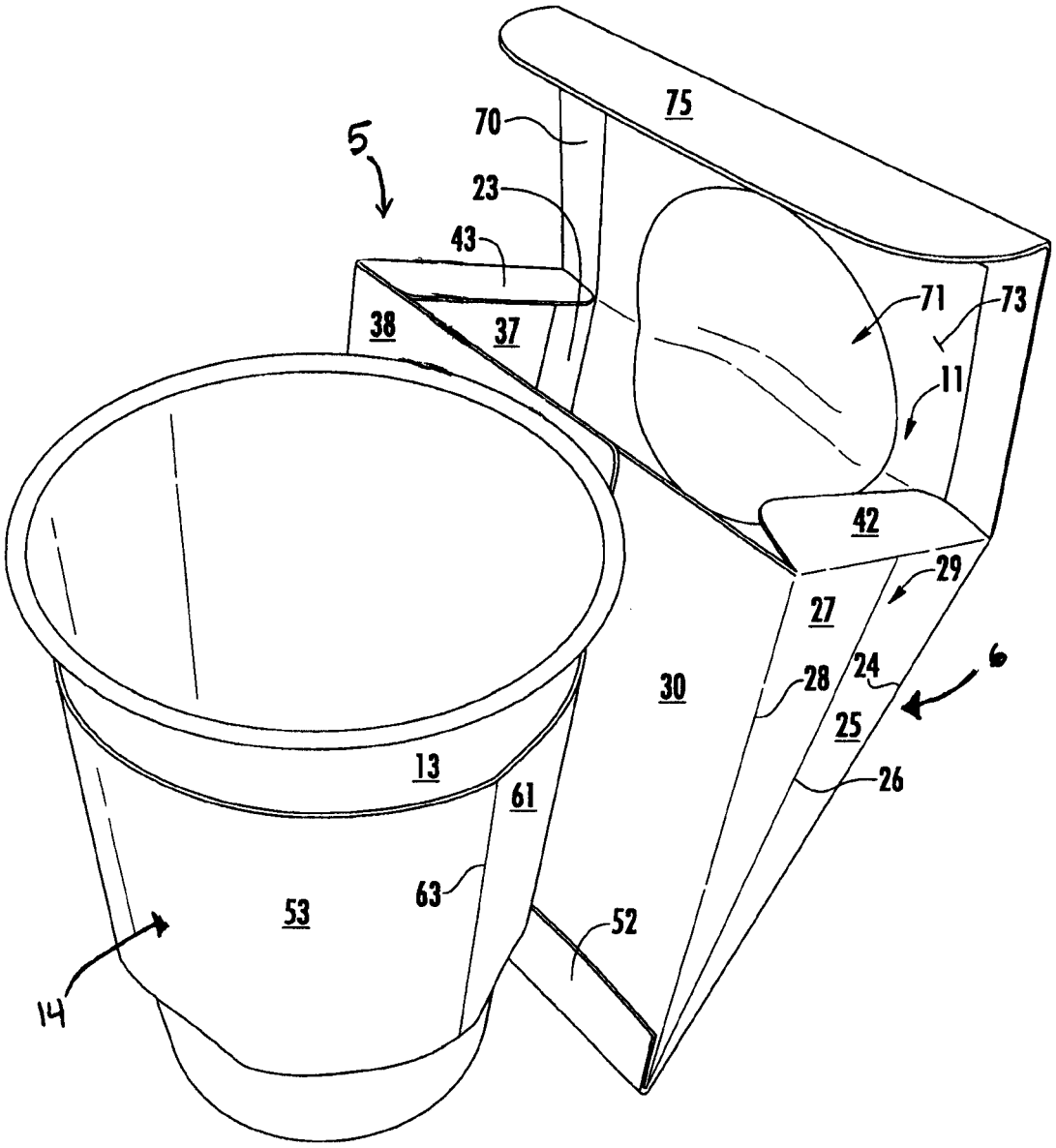
FIG. 10 is a back perspective view of the carton with the container and the carton in the open configuration.

As shown in FIGS. 2-10, and described in the following in accordance with one acceptable example, the carton 5 is formed from the blank 3 by folding panels 27, 30, 35, 38 about respective fold lines 26 and 34 such that the first back panel 30 and the second back panel 38 with attachment flap 39 are at least partially in face-to-face contact and at least partially form an interior 11 of the container 6, for example, by creating a flattened wedge-shaped box with flattened gusseted panels 25, 27, 33, 35 as shown in FIG. 3. Attachment flap 39 may receive adhesive or glue and may be affixed to an interior surface of the first back panel 30 (FIG. 3). Upon formation of the container 6 in the form of the flattened wedge-shaped box of FIG. 3, panels 61 and 62 of the carrier feature 60 may be folded about fold lines 63 and 64 to at least partially form the carrier formation 14 (FIG. 4). Glue may be applied to attachment flaps 65, 66 which may be affixed to each other. In the position of FIG. 4, a marginal portion of the overlapped flaps 65, 66 are in face-to-face contact with protruding portion 54 of the attachment flap 52. Glue may be applied to attach the overlapped flaps 65, 66 to the protruding portion 54 of the attachment flap 52. Also, glue may be applied to the base portion 52*a* (FIG. 4) of the attachment flap 52 to attach the base portion to the first and second back panels 30, 38. When the attachment flap 52 and connected carrier features 60 are upwardly folded about fold line 51 from the position of FIG. 4 to the position of FIG. 5, the base portion 52*a* of the attachment flap is attached to the back panels 30, 38 and the overlapped flaps 65, 66 of the carrier features 60 are attached to the first and second back panels 30, 38 of the container 6. The carrier features 60 can be further formed into the carrier 14 by tearing at tear lines 55, 56 and perforated cut line 57 to open the carrier formation 14 (FIG. 6) by separating the first carrier panel 53 from the attachment flap 52 to allow the carrier panel 53 to move away from the panels 61, 62, 65, 66 to form a generally opened-ended sleeve attached to the container 6. Additionally, top panel 70 may be folded about fold line 76 and relative to the front panel 23 after positioning the gusseted panels 29, 37 to form substantially flat first and second side panels 29, 37 to close the interior or product holding space 11 of the container 6 (FIGS. 7 & 8). The carton 5, container 6, and carrier 14 can be formed by other steps without departing from the disclosure.

The container 6 may be filled with a single serving product (such as a food product/sandwich F) or multiple products to be held therein during any suitable portion of carton formation, for example, or after the carton is formed. The product F may be placed in the interior space 11 of the container 6 after shipment of the carton 5, for example, by way of self-service by a user wishing to purchase a beverage and/or food product. As shown in FIG. 8, a food product F may initially come packaged in container 6 while the carrier formation 14 is flattened for storage. Upon inspection, a user may select the carton 5 having the desired food product in the container 6 as shown in FIG. 8 and thereafter activate the carrier formation 14 and insert a beverage container 13 and/or lid 15 as shown in FIG. 9 into the sleeve of the carrier 14. As shown in FIG. 7, the carrier 14 can be attached to one or both of the overlapped back panels 30, 38 by adhesive such as glue or other suitable attachment mechanisms. In this manner, the carton 5 includes a container 6 holding a food product, and a carrier 14 for carrying a beverage container. The window 71 is useful to allow a consumer to inspect the contents of the container 6 so that they can select the desired food product F without opening the carton 5. The carton 5, container 6, and carrier 14 can be used in any suitable manner other than what is shown and described herein without departing from the disclosure.

Figure 11:
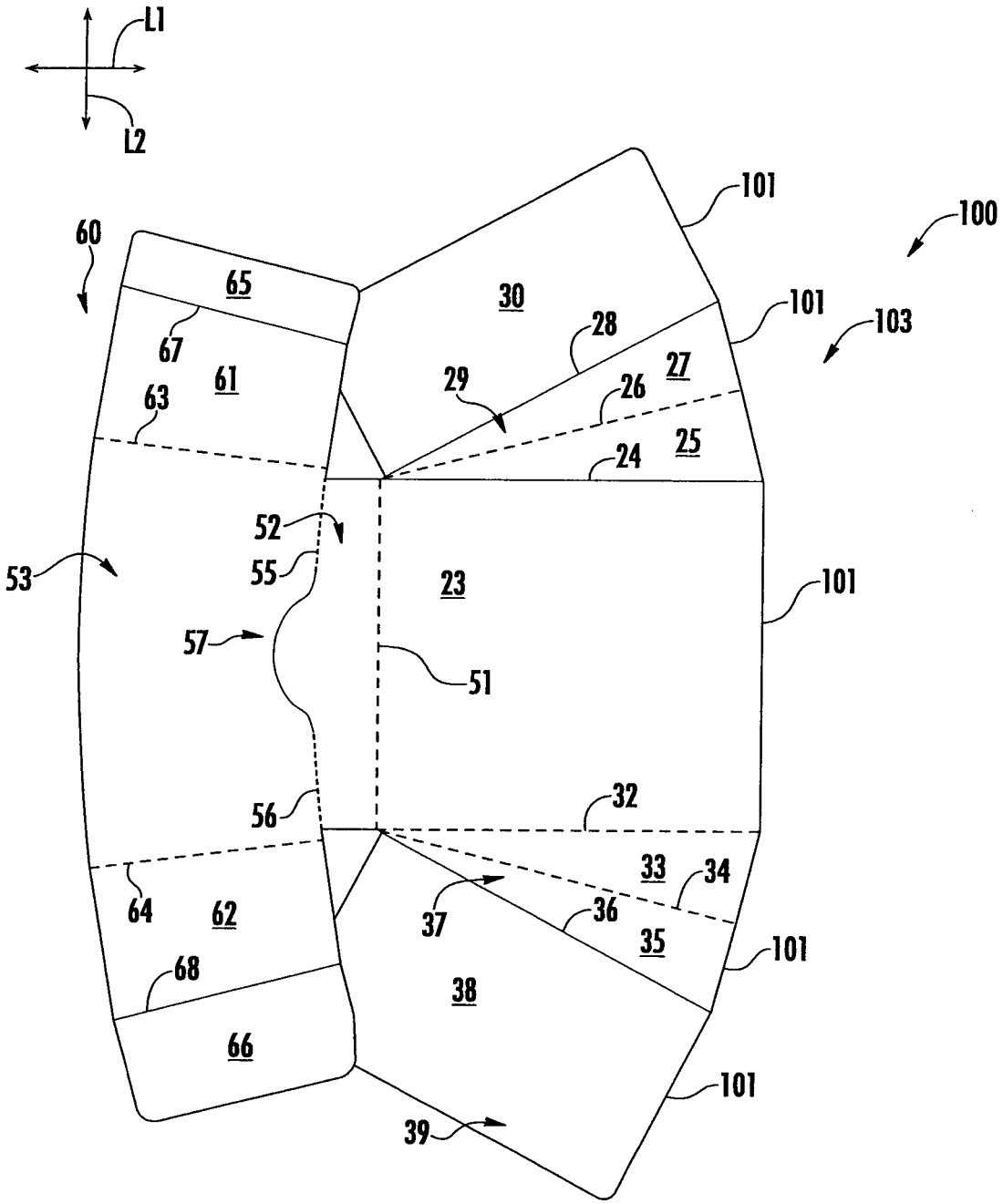
FIG. 11 is an exterior plan view of a blank used to form a carton in accordance with a second embodiment of the disclosure.

Turning to FIG. 11, a plan view of an exterior surface 100 of a blank 103 used to form a carton of a second embodiment of the disclosure is provided. The blank 103 may be substantially similar to the blank 3 with like reference numerals referencing the same elements. However, the blank 103 may omit the top panel 70, end flaps, 40, 41, 75, and window formation 71. Instead, a top edge 101 is formed along the perimeter of the interior or product section 11 of the formed carton providing an open top of the carton for easy access to contents placed therein.

It is understood that the blank 103 of the second embodiment may be erected into a carton similar to the carton 5 of the first embodiment, in a similar manner as described above for the carton of the first embodiment. In the second embodiment, a food product F can be placed in the open top of the carton and held in the interior 11 in a similar manner as the first embodiment. The carrier 14 of the carton of the second embodiment can be formed and used in a similar manner as the first embodiment of the carton.

The cartons, and various blanks for forming cartons, are shown and described by way of example. Any of the features of the various embodiments of the disclosure can be combined with, replaced by, or otherwise configured with other features of other embodiments of the disclosure without departing from the scope of this disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, kraft lined paperboard, double kraft lined paperboard, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a first product and a second product, the carton comprising:

a container comprising a plurality of panels that extends at least partially around an interior of the container, the plurality of panels comprises a front panel, a first side panel, a second side panel, a first back panel and a second back panel, the interior is for holding the first product, the plurality of panels are foldably connected at a bottom edge of the container;

a carrier attached to at least one of the plurality of panels for holding the second product; and an attachment flap foldably connected at the bottom edge of the container and foldably connected to the front panel at a lateral fold line, the lateral fold line at least partially defines the bottom edge, and the attachment flap attaches the carrier to the container; and wherein the first side panel is foldably connected to the front panel along a first fold line, the second side panel is foldably connected to the front panel along a second fold line, the first back panel is foldably connected to the first side panel along a third fold line, and the second back panel is foldably connected to the second side panel along a fourth fold line, the first fold line, the second fold line, the third fold line, and the fourth fold line extend obliquely from the bottom edge.

2. The carton of claim 1, wherein the carrier comprises a plurality of carrier panels that form a sleeve, at least one of the plurality of carrier panels is in face-to-face contact with at least one of the plurality of panels of the container.

3. The carton of claim 2, wherein the attachment flap comprises a base portion in face-to-face contact with the at least one of the plurality of panels of the container and a protruding portion in face-to-face contact with the at least one of the plurality of carrier panels of the carrier.

4. The carton of claim 2, wherein the plurality of carrier panels comprises a first carrier panel, a second carrier panel, and a third carrier panel, the second carrier panel is foldably connected to the first carrier panel, and the third carrier panel is foldably connected to the first carrier panel.

5. The carton of claim 4, wherein a first carrier attachment flap is connected to the second carrier panel and a second carrier attachment flap is connected to the third carrier panel, the first carrier attachment flap and the second carrier attachment flap are configured to overlap to form the carrier, at least one of the first carrier attachment flap and the second carrier attachment flap is attached to at least one of the plurality of panels of the container.

6. The carton of claim 5, wherein the attachment flap is in face-to-face contact with at least one of the first carrier attachment flap and the second carrier attachment flap.

7. The carton of claim 1, wherein the first side panel comprise a first gusset panel and a second gusset panel, the first gusset panel is foldably connected to the second gusset panel, and the second side panel comprise a third gusset panel and a fourth gusset panel, the third gusset panel is foldably connected to the fourth gusset panel.

8. The carton of claim 1, wherein the plurality of panels further comprises a top panel foldably connected to the front panel.

9. The carton of claim 8, wherein the carton comprises a window in at least one of the plurality of panels to allow viewing of the first product.

10. The carton of claim 9, wherein the window comprises an opening in at least one of the top panel and the front panel.

11. The carton of claim 10, wherein the window comprises a transparent film covering the opening.

12. The carton of claim 1, wherein the container comprises a first end flap foldably connected to the first side panel and a second end flap foldably connected to the second side panel, the first end flap and the second end flap cooperate to at least partially close an end of the container.

13. The carton of claim 12, wherein the plurality of panels further comprises a top panel foldably connected to the front panel, the top panel cooperating with the first end flap and the second end flap to close the end of the container.

14. The carton of claim 13, wherein the carton comprises a top end flap foldably connected to the top panel, the top end flap cooperating to close the end of the container, the top end flap being for securing the top panel in a closed position closing the end of the container.

15. The carton of claim 14, wherein the top end flap is in face-to-face contact with at least one of the first back panel and the second back panel.

16. A carton for holding a first product and a second product, the carton comprising:

a container comprising a plurality of panels that extends at least partially around an interior of the container, the plurality of panels comprises a front panel, a first side panel, a second side panel, and at least one back panel, the interior is for holding the first product, the plurality of panels are foldably connected at a bottom edge of the container;

a carrier attached to at least one of the plurality of panels for holding the second product, the carrier comprises a plurality of carrier panels that form a sleeve, at least one of the plurality of carrier panels is in face-to-face contact with at least one of the plurality of panels of the container; and an attachment flap foldably connected at the bottom edge of the container, the attachment flap is foldably connected to at least one of the plurality of panels and attaches the carrier to the container; and wherein at least one of the plurality of carrier panels is removably attached to the attachment flap along a line of weakening.

17. The carton of claim 16, wherein the line of weakening comprises at least one tear line.

18. The carton of claim 17, wherein the line of weakening comprises at least one cut line.

19. A blank for forming a carton for holding a first product and a second product, the blank comprising:

a container portion for forming a container for holding the first product, the container portion comprising a plurality of panels for forming an interior of the container, the plurality of panels comprises a front panel, a first side panel, a second side panel, a first back panel and a second back panel, a carrier portion for forming a carrier for holding the second product; and an attachment flap foldably connected to the front panel at a lateral fold line for forming a bottom edge of the container, the lateral fold line at least partially defines the bottom edge, and the attachment flap is for attaching the carrier to the container in the carton formed from the blank; and wherein the first side panel is foldably connected to the front panel along a first fold line, the second side panel is foldably connected to the front panel along a second fold line, the first back panel is foldably connected to first side panel along a third fold line, and the second back panel is foldably connected to the second side panel along a fourth fold line, the first fold line, second fold line, third fold line, and fourth fold lines extend obliquely from the lateral fold line.

20. The blank of claim 19, wherein the carrier portion comprises a plurality of carrier panels for forming a sleeve, the attachment flap comprises a base portion in face-to-face contact with the at least one of the plurality of panels of the container and a protruding portion in face-to-face contact with the at least one of the plurality of carrier panels of the carrier.

21. The blank of claim 20, wherein the plurality of carrier panels comprises a first carrier panel, a second carrier panel, and a third carrier panel, the second carrier panel is foldably connected to the first carrier panel, and the third carrier panel is foldably connected to the first carrier panel.

22. The blank of claim 21, wherein a first carrier attachment flap is connected to the second carrier panel and a second carrier attachment flap is connected to the third carrier panel, the first carrier attachment flap and the second carrier attachment flap are configured to overlap to form the carrier, at least one of the first carrier attachment flap and the second carrier attachment flap is attached to at least one of the plurality of panels of the container portion.

23. The blank claim 19, wherein the first side panel comprise a first gusset panel and a second gusset panel, the first gusset panel is foldably connected to the second gusset panel, and the second side panel comprise a third gusset panel and a fourth gusset panel, the third gusset panel is foldably connected to the fourth gusset panel.

24. The blank of claim 19, wherein the plurality of panels further comprises a top panel foldably connected to the front panel.

25. The blank of claim 19, wherein the carton portion comprises a window in at least one of the plurality of panels.

26. The blank of claim 25, wherein the window comprises an opening in at least one of the top panel and the front panel.

27. The blank of claim 26, wherein the window comprises a transparent film covering the opening.

28. The blank of claim 19, wherein the plurality of panels further comprises a top panel foldably connected to the front panel, and the container portion comprises a first end flap foldably connected to the first side panel, a second end flap foldably connected to the second side panel, and a top end flap foldably connected to the top panel.

29. A blank for forming a carton for holding a first product and a second product, the blank comprising:

a container portion for forming a container for holing the first product, the container portion comprising a plurality of panels for forming an interior of the container, the plurality of panels comprises a front panel, a first side panel, a second side panel, and at least one back panel, a carrier portion for forming a carrier for holding the second product, the carrier portion comprises a plurality of carrier panels for forming a sleeve; and an attachment flap foldably connected to at least one of the plurality of panels at a lateral fold line for forming a bottom edge of the container, the attachment flap comprises a base portion in face-to-face contact with the at least one of the plurality of panels of the container and a protruding portion in face-to-face contact with the at least one of the plurality of carrier panels of the carrier, the attachment flap is for attaching the carrier to the container in the carton formed from the blank, and wherein at least one of the plurality of carrier panels is removably attached to the attachment flap along a line of weakening.

30. The blank of claim 29, wherein the line of weakening comprises at least one tear line.

31. The blank of claim 30, wherein the line of weakening comprises at least one cut line.

32. A method of forming a carton for holding a first product and a second product, the method comprising:

obtaining a blank comprising a container portion comprising a plurality of panels comprising a front panel, a first side panel, a second side panel, a first back panel and a second back panel, a carrier portion, and an attachment flap foldably to the front panel at a lateral fold line, the first side panel is foldably connected to the front panel along a first fold line, the second side panel is foldably connected to the front panel along a second fold line, the first back panel is foldably connected to the first side panel along a third fold line, and the second back panel is foldably connected to the second side panel along a fourth fold line, the first fold line, the second fold line, the third fold line, and the fourth fold lines extend obliquely from the bottom edge;

forming a container from the container portion by positioning the plurality of panels to extend at least partially around an interior of the container, the interior is for holding the first product, the plurality of panels are foldably connected at a bottom edge of the container, the lateral fold line at least partially defines the bottom edge; and positioning the attachment flap to attach the carrier portion to at least one of the plurality of panels, the positioning the attachment flap comprises folding the attachment flap at the lateral fold line to four the bottom edge of the container.

33. The method of claim 32, wherein the carrier comprises a plurality of carrier panels and the method comprises positioning at least one of the plurality of carrier panels in face-to-face contact with at least one of the plurality of panels of the container.

34. The method of claim 33, wherein the attachment flap comprises a base portion and a protruding portion, the positioning the attachment flap comprises positioning the base portion in face-to-face contact with the at least one of the plurality of panels of the container and positioning the protruding portion in face-to-face contact with the at least one of the plurality of carrier panels of the carrier.

35. The method of claim 33, wherein the positioning the plurality of carrier panels comprises separating the at least one of the plurality of carrier panels by tearing along a line of weakening.

36. The method of claim 32, wherein the plurality of panels further comprises a top panel foldably connected to the front panel and the carton comprises a window in at least one of the plurality of panels to allow viewing of the first product.

37. The method of claim 32, wherein the container portion comprises a top panel foldably connected to the front panel, a first end flap foldably connected to the first side panel, and a second end flap foldably connected to the second side panel, the method comprises closing an end of the container by positioning the top panel, the first end flap, and the second end flap.

38. The method of claim 37, wherein the carton comprises a top end flap foldably connected to the top panel, the closing an end comprises positioning the top end flap to secure the top panel in a closed position.

39. The method of claim 38, wherein the positioning the top end flap comprises positioning the top end flap in face-to-face contact with at least one of the first back panel and the second back panel.

40. A method of forming a carton for holding a first product and a second product, the method comprising:

obtaining a blank comprising a container portion comprising a plurality of panels comprising a front panel, a first side panel, a second side panel, and at least one back panel, a carrier portion, and an attachment flap foldably connected to at least one of the plurality of panels at a lateral fold line, the carrier portion comprising a plurality of carrier panels and at least one of the plurality of carrier panels is removably attached to the attachment flap along a line of weakening;

forming a container from the container portion by positioning the plurality of panels to extend at least partially around an interior of the container, the interior is for holding the first product, the plurality of panels are foldably connected at a bottom edge of the container;

positioning the attachment flap to attach the carrier portion to at least one of the plurality of panels, the positioning the attachment flap comprises folding the attachment flap at the lateral fold line to form the bottom edge of the container, positioning at least one of the plurality of carrier panels in face-to-face contact with at least one of the plurality of panels of the container, and positioning the plurality of carrier panels to form the carrier.

41. The method of claim 40, further comprising placing the first product in the interior of the container.

42. The method of claim 41, further comprising placing the second product in the carrier.

43. The method of claim 40, wherein the plurality of carrier panels comprises a first carrier panel, a second carrier panel, and a third carrier panel, the second carrier panel is foldably connected to the first carrier panel, and the third carrier panel is foldably connected to the first carrier panel.

44. The method of claim 43, wherein a first carrier attachment flap is connected to the second carrier panel and a second carrier attachment flap is connected to the third carrier panel, the forming the carrier comprises overlapping the first carrier attachment flap and the second carrier attachment and attaching at least one of the first carrier attachment flap and the second carrier attachment flap to at least one of the plurality of panels of the container.

45. The method of claim 44, wherein the positioning the attachment flap comprises positioning the attachment flap in face-to-face contact with at least one of the first carrier attachment flap and the second carrier attachment flap.

* * * * *